United States Patent [19]

McMahon

[11] Patent Number: 5,048,270

[45] Date of Patent: Sep. 17, 1991

[54] WRINKLE FREE FILM SPREADER DEVICE FOR FORM, FILL AND SEAL MACHINES

[75] Inventor: Michael J. McMahon, Palatine, Ill.

[73] Assignee: Zip-Pak Incorporated, Northbrook, Ill.

[21] Appl. No.: 470,807

[22] Filed: Jan. 26, 1990

[51] Int. Cl.[5] ..... B65B 9/06

[52] U.S. Cl. ..... 53/551; 493/255; 493/311

[58] Field of Search ..... 53/450, 451, 550, 551, 53/552; 493/255, 302, 308, 311

[56] References Cited

U.S. PATENT DOCUMENTS

| | | | |
|---|---|---|---|
| 2,720,680 | 10/1955 | Gerow | 493/302 X |
| 3,492,775 | 2/1970 | Rhine et al. | 53/451 |
| 3,543,477 | 12/1970 | Leasure | 53/551 |
| 3,831,821 | 8/1974 | Doyen | 53/451 X |
| 4,129,976 | 12/1978 | Gründler et al. | 493/302 X |
| 4,235,064 | 11/1980 | Wenger | 53/451 |
| 4,589,247 | 5/1986 | Tsuruta et al. | 53/551 X |
| 4,640,083 | 2/1987 | Takahashi et al. | 53/551 |
| 4,697,403 | 10/1987 | Simpson et al. | 53/551 |
| 4,745,731 | 5/1988 | Talbott et al. | 53/451 |
| 4,829,745 | 5/1989 | Behr et al. | 53/451 |

FOREIGN PATENT DOCUMENTS

| | | | |
|---|---|---|---|
| 512116 | 6/1976 | U.S.S.R. | 53/551 |

*Primary Examiner*—Robert L. Spruill
*Assistant Examiner*—Daniel B. Moon
*Attorney, Agent, or Firm*—Hill, Van Santen, Steadman & Simpson

[57] ABSTRACT

A spreader device for the lower end of a forming and filling tube of a form, fill and seal machine has an operator located on the outside of the upper end of the tube. The operator may effect oscillations causing the finger to swing into and out of spreading position, or the operator may cause the finger to reciprocate into and out of spreading position.

20 Claims, 2 Drawing Sheets

WRINKLE FREE FILM SPREADER DEVICE FOR FORM, FILL AND SEAL MACHINES

BACKGROUND OF THE INVENTION

The present invention relates to a new and improved device for wrinkle free spreading of the tubularly shaped package making film after it leaves the lower end of a forming and filling nozzle tube and is then sealed across the film into individual packages by means of the customary pull down and sealing mechanism associated with machines of this type.

As pointed out in U.S. Pat. No. 4,829,745, one of the problems that has occurred in vertical form, fill and seal machines has been that wrinkles tend to form along the edge seal lines of the packages during the edge sealing operation which is accomplished by means of the customary sealing and pull down mechanism. This mechanism functions to seal each succeeding bag or package and pull the package making film downwardly a package increment at a time below the discharge or filling end of the vertical forming and filling tube of the machine.

According to U.S. Pat. No. 4,829,745 the spreader device disclosed therein is used for spreading the formed film in coordinated relation with operation of the sealing and pull down to eliminate wrinkles that otherwise would develop along the edge seal lines because of the loading of the package with product. However, that mechanism can be substantially improved as will become apparent herein. In order to minimize the need for background description details, U.S. Pat. No. 4,829,745 is incorporated herein by reference.

SUMMARY OF THE PRESENT INVENTION

An important object of the present invention is to provide a new and improved spreader means for the lower end of a forming and filling tube in a package making apparatus of the kind described, which is of more simple, efficient, economical, less cumbersome construction than heretofore available.

Another object of the present invention is to provide a new and improved film spreader device which minimizes interference with the internal product passage in a package making material forming and filling tube.

Pursuant to the present invention, there is provided in a form, fill and seal machine including a vertical forming and filling tube having a package-making-film guiding shoulder means on the outside of an upper end portion of the tube and film sealing and pull-down means operatively located below the lower end of the tube, spreader means at the lower end of the tube for wrinkle free spreading of package making film pulled from the lower end of the tube by the film sealing and pull-down means, and means for operating the spreader means located on the outside of the upper end portion of the tube adjacent to but clear of the film guiding shoulder means.

BRIEF DESCRIPTION OF THE DRAWINGS

Other objects, features and advantages of the present invention will be readily apparent from the following description of certain preferred embodiments thereof, taken in conjunction with the accompanying drawings, although variations and modifications may be effected without departing from the spirit and scope of the novel concepts of the disclosure, and in which.

DETAILED DESCRIPTION

Figure 1:
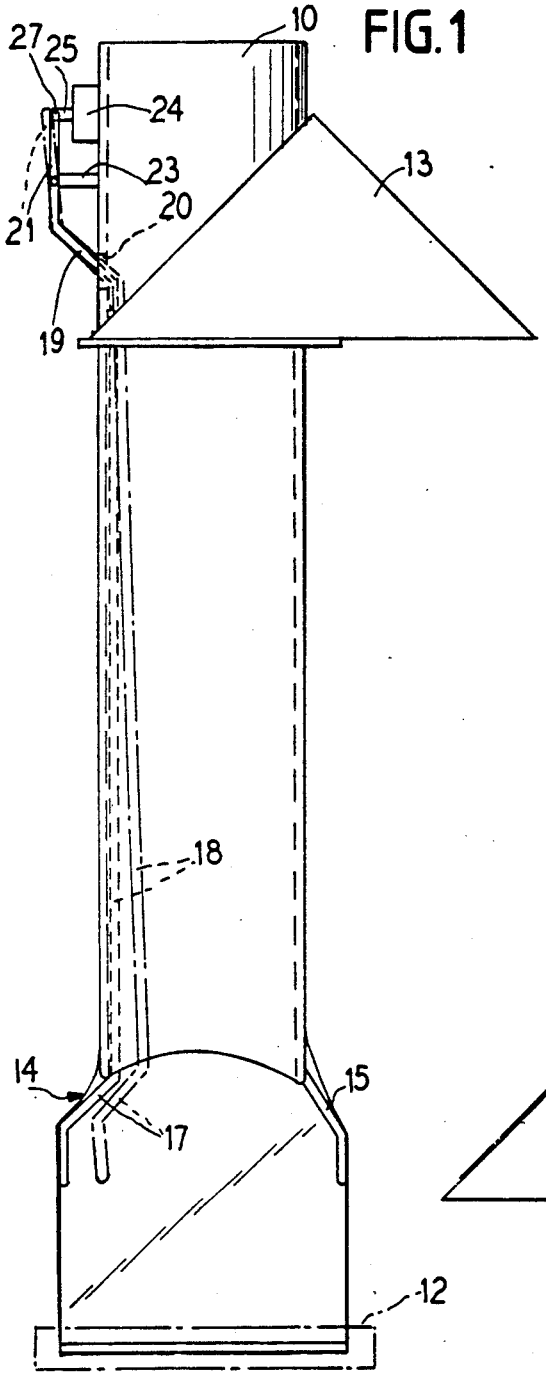
FIG. 1 is a more or less schematic elevational view of an apparatus embodying a preferred form of the spreader means, and showing the same in projected operating mode.
Figure 2:
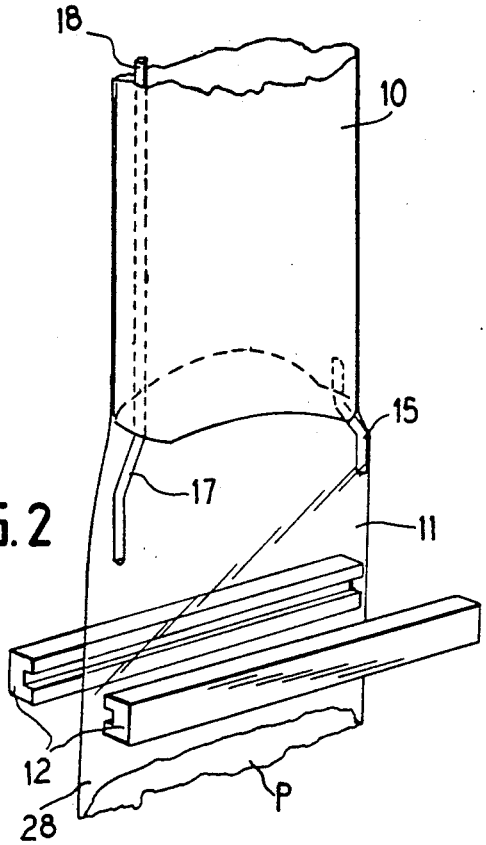
FIG. 2 is a fragmentary perspective view of the apparatus of FIG. 1 showing the spreader in retracted mode.
Figure 3:
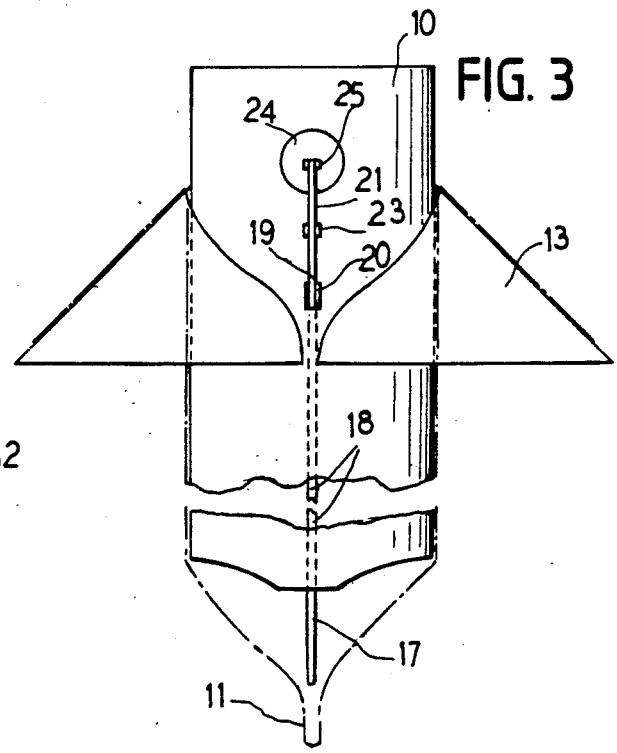
FIG. 3 is a fragmental elevational view of the apparatus of FIG. 1 looking toward the right in FIG. 1.

In a conventional form, fill and seal machine as representatively shown in FIGS. 1–3, a vertical forming and filling nozzle or tube 10, is as is well known, associated with product supply means which deposits product into the upper end of the tube for deposit through the lower open end of the tube into successive bags or packages formed from tubularly shaped bag making film 11 which is sealed by conventional sealing and cutoff means comprising complementary reciprocatable sealing bars operatively located below the lower end of the tube 10. Film guiding shoulder means 13 are mounted on the upper end portion of the tube 10, and the film 11 is received from a suitable supply, not shown, and guided by the collar mean 13 onto and about the tube 10 in customary matter. As tubularly shaped about the tube 10, the film 11 is adapted to be closed in the tubular shape for bag or package making purposes and such closing may be effected by sealing a vertical joint where the edges of the film 11 are brought together. Where the film material 11 is equipped with extruded profile plastic fastener or zipper means the zipper is closed in shaping the material tubularly about the tube 10. Such closing means, though not shown herein are conventional and may, for example, be generally in accordance with such means disclosed in the aforesaid U.S. Pat. No. 4,829,745.

The sealing and pull down bars 12 are operated in customary manner in step-by-step coordinated relation with feeding of product through the tube 10 into each successively formed package, as is a known technique. Each succeeding package is sealed along the lower side by the sealing bars 12 which concurrently pulls the material 11 downwardly another bag length. The sealing bars 12 then release the package edge seal just formed and rise upwardly into position for edge sealing the next succeeding package which is filled in the bar rising interval so that when the sealing bars reach the top of their operating stroke the succeeding bag will have been filled and the bars can immediately move into cooperative sealing relation for sealing the top edge of the filled bag and the lower edge of the next succeeding bag.

However, as product is loaded into the next succeeding bag, the weight of the product tends to distort and wrinkle the material above the immediately preceding edge seal formed by the bars 12, so that in the absence of means to avoid wrinkling, undesirable wrinkles will be sealed into the edge seals. It is to the avoidance of such wrinkling that the present invention is directed and comprises spreader means 14 at the lower end of the tube 10 for wrinkle free spreading of the material 11 in coordination with the cyclical operation of the sealing bars 12.

In a preferred form, the spreader means 14 comprises a fixed spreader finger 15 and an oscillatable spreader finger 17. The spreader fingers 15 and 17 are located diametrically opposite to one another at the lower end of the tube 10, and at the positions relative to the material 11 where the bottom ends of the packages are produced in regard to the fixed finger 15, and where the top ends of the packages are produced with respect to the finger 17. As best seen in FIG. 1, the fixed spreader finger 15 is fixedly attached to the tube 10 and projects downwardly and laterally therefrom. The movable spreader finger 17 is mounted to extend downwardly and laterally from the lower end of the tube 10 complementary to the finger 15 in the fully material spreading relation of the finger as shown in full outline in FIG. 1. The finger 17 is then movable laterally inwardly into retracted position during pull-down of the material 11 by means of the sealing and pull-down bars 12 so as to minimize frictional drag.

For oscillatably shifting the spreader finger 17 between the spreading protracted position as shown in full outline in FIG. 1 and the retracted position shown in dot dash outline in FIG. 1, and the full line position shown in FIG. 2, the finger 17 is provided with an extension leg 18 which extends upwardly within the tube 10 to a point adjacent to the guide collar means 13. There the leg 18 has a mounting and actuating formation which in part includes a generally diagonally upwardly and outwardly extending offsetting upper portion 19 of the leg 18 which projects through a clearance opening 20 (FIGS. 1 and 3). At the outer end of the offset 19, another part of the mounting and actuating formation includes an upstanding terminal portion 21 which is positionally controlled by being intermediately attached as by means of an overhanging pivot 22 to a fixed bracket 23 attached to the outside of the tube 10 above the opening 20 and clear of the collar means 13. Above the pivot 22 the portion 21 is attached to a pneumatic actuator 24 which has a piston rod 25 attached as by means of a pivot 27 to the upper extremity of the terminal portion 21. Conveniently, the pneumatic actuator 24 is mounted on the upper end portion of the tube 10, although if it would be more convenient, the actuator could be mounted on some adjacent portion of the machine or frame of the machine. The important consideration is that the mounting means including the bracket 23 and the actuating means comprising the actuator 24 be located outside of the passage of tube 10 so as to avoid interference with free flow of product down the tube. Furthermore, such outside location of the operating mechanism for the spreader finger 17 avoids contamination of the operating mechanism and more particularly the relatively moving parts from the product or dust, sugar, coating material, or other product-related substance that might be deleterious to the proper and continued efficient functioning of the operating mechanism. It will also be apparent that the simple one-piece straight heavy wire or thin rod construction of the arm 18 offers minimum interference with free flow of product thereby down the passage within the tube 10. As a complement to this, the downwardly slanted relation of the offset 19 and the finger 17 permits product to pass freely and without hangup thereon down the tube passage.

In operation, when the sealing bars 12 are ready to effect an edge seal closing of the upper side of the last formed package and the lower side of the next formed package, the fingers 15 and 17 cooperate to effect full generally flattened spreading of the package material 11 from the tubular relation about the forming and filling tube 10 into a generally flattened spread condition as seen in FIGS. 1 and 2. This maintains the material 11 substantially free from wrinkles while the sealing bars 12 engage in their package-edge-sealing relation. Coordinated with completion of the edge sealing action of sealing bars 12, the pneumatic actuator 24 rocks the spreader finger 17 to the retracted position, from the extended spreading position so that drag upon free downward movement of the material 11 in the succeeding bag increment is avoided. At conclusion of the down pull on the material 11, the sealing bars 12 are spread open and raised as shown in FIG. 2 while the spreader finger 17 remains retracted until the next fill of product P is discharged into the next succeeding bag and the sealing bars 12 are ready to return to the clamping sealing relationship, whereupon the finger 17 is again protracted into its spreading position in repetition of the sealing and pull down operation.

Figure 4:
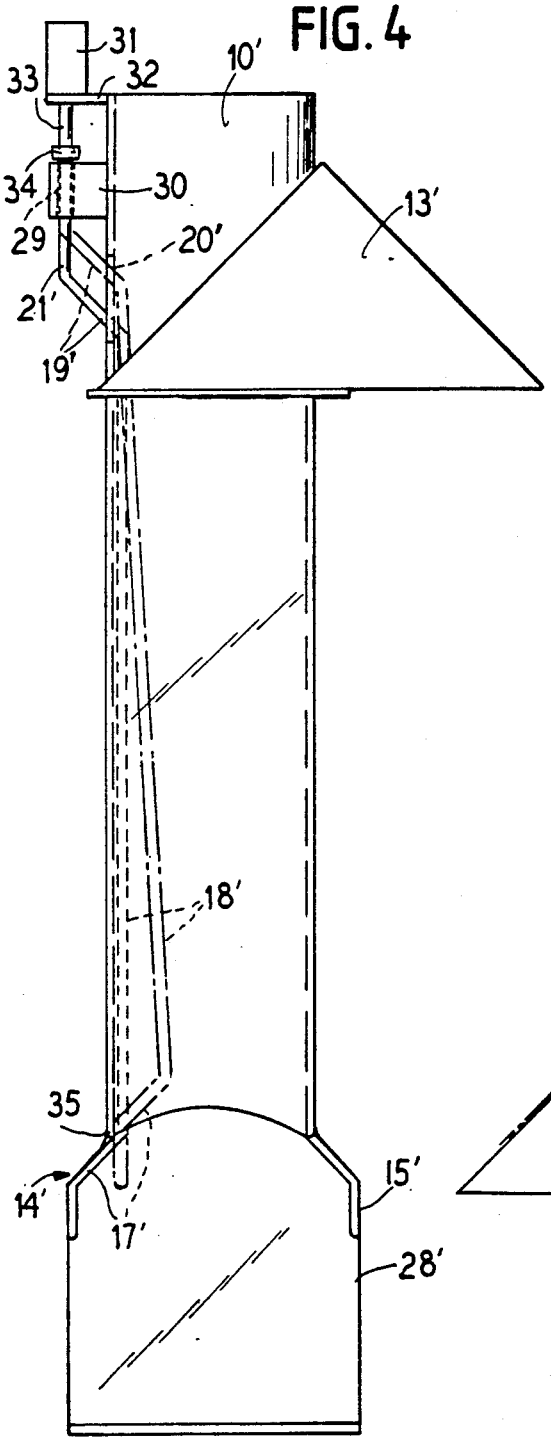
FIGS. 4, 5 and 6 are views similar to FIGS. 1–3 but showing a modified form of the spreader device of the present invention.
Figure 5:
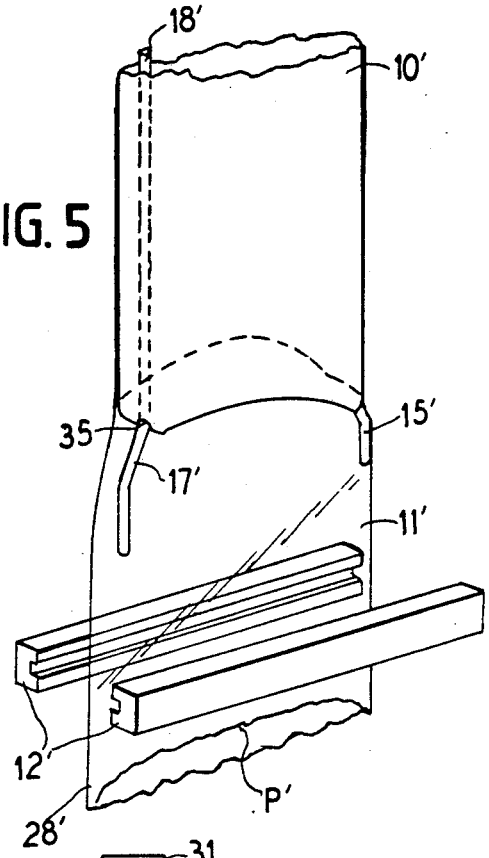
Figure 6:
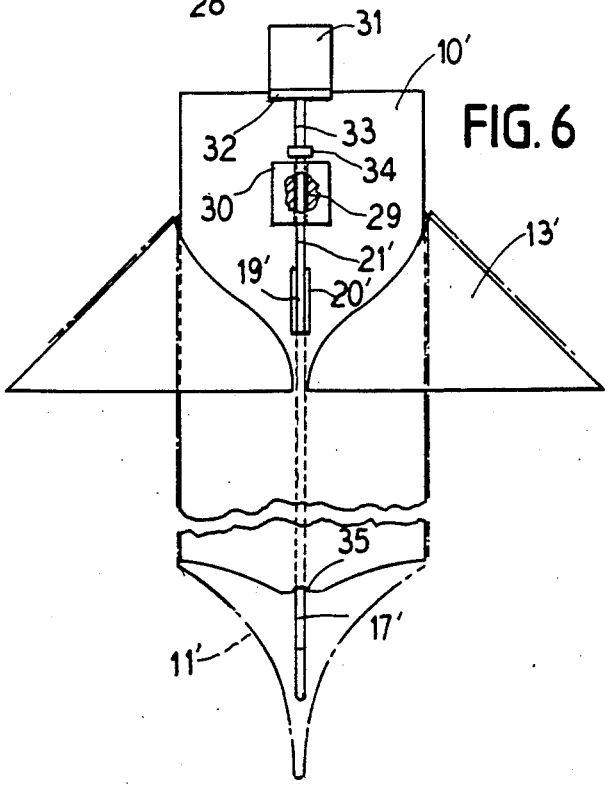

In FIGS. 4, 5 and 6 all of the parts of the apparatus are the same as in FIGS. 1–3 except for the operating means for the spreader finger 17′ of the spreader means 14′ in which, however, the spreader finger 15′ is the same as the spreader finger 15 in FIG. 1. While the spreader finger 17′ extending diagonally to its angular connection with the leg 18′, and the offset 19′ and the terminal portion 21′ are the same as the equivalent elements in FIG. 1, the finger 17′ is operated reciprocally endwise between protracted position as shown in full line in FIG. 4 and the retracted position shown in dot dash outline in FIG. 4 and full line position shown in FIG. 5. For this purpose, the terminal portion 21′ extends reciprocally through a vertical guide bore 29 in a bracket 30 which may conveniently be mounted on the outer side of the tube 10′ clear of the film guide collar means 13′. For reciprocally operating the finger 17′, actuator means such as a pneumatic actuator 31 may be mounted on a fixed bracket 32 on the upper end of the tube 10′ so that a piston rod 33 of the actuator coupled by means such as a coupling 34 to the upper end of the finger arm terminal 21′ is adapted to effect vertical movements of the finger 17′ in operation of the finger. The offset 19′ extends through a vertically elongated form, of the clearance aperture 20′ in the wall of the tube 10′.

In operation of the apparatus of FIGS. 4–6, the actuator 31 causes the finger 17′ to shift into its spreading position as shown in full outline in FIG. 4 when the sealing bars 12′ are in the ready to seal position. Immediately after completion of the edge sealing of the upper side of the completed filled bag and the lower side of the next succeeding bag, the actuator 31 causes the finger 17′ to be shifted upwardly whereupon the angularly downwardly and outwardly slanted finger 17′ cams on the contiguous lower edge of the tube 10′ which is desirably provided with a cam groove 35 along which the slanting finger 17′ is shifted upwardly and thereby cams the finger 17′ inwardly into clearance relation to the lower edge of the tube 10′ so that upon the downward film drawing cycle of the sealing bars 12′, frictional resistance will be minimized. To facilitate the retraction and extension reciprocal movements of the finger 17′, the leg 18′ is desirably of sufficient resilient flexibility to enable the finger to be cammed inwardly as the finger mechanism is drawn upwardly, and to slidably spread or protract outwardly when the finger mechanism is lowered.

It will be understood that variations and modifications may be effected without departing from the spirit and the scope of the novel concepts of the present invention.

I claim as my invention:

1. In a form, fill and seal machine including a vertical forming and filling tube having an upper product receiving end portion and a lower product discharge end, a package-making film guiding collar means about said upper end portion of said tube, and film sealing and pull down means below said lower discharge end and functioning to draw package making film through said guide collar means into tubular relation about said tube and to draw the tubular film downwardly below said discharge end and then sealing the tubular film at bag width intervals;

spreader means at said discharge end for laterally stretching the tubularly formed bag making film in a vertical plane to eliminate wrinkle unevenness when the sealing means seals across the film;

said spreader means including an elongate one-piece spreader member with a leg extending longitudinally within said tube, said leg further comprising as a fixed extension on a lower end thereof an integral spreader finger formation located at the discharge end of said tube within said tubular film;

an upper end of said leg having an obliquely and upwardly extending mounting and actuating formation extending outwardly relative to said upper end portion of said tube and in clearance relation to said guide shoulder means;

supporting means engaged by said mounting and actuating formation; and actuator means operatively controlling said upper end formation for effecting movements of said member and thereby controlling movements of aid lower end spreader finger formation between a wrinkle free spreading of the tubular film below said discharge end of said tube and a retracted position for relatively free downward movement of said tubular film when said sealing and pull down means pulls the tubular film downwardly.

2. A machine according to claim 1, wherein said actuator means includes a device for causing said member to swing oscillatably.

3. A machine according to claim 1, wherein said mounting and actuating formation has a portion extending out through an opening in the tube.

4. A machine according to claim 1, wherein said supporting means comprises a bracket mounted on said tube, and pivot means effecting the engagement of said actuating formation with said bracket.

5. A machine according to claim 1, wherein said finger formation comprises a portion which extends downwardly and outwardly on a slant for spreading engagement with the tubular film.

6. A machine according to claim 1, including a fixed finger on the lower end of said tube cooperatively related to said spreader finger formation and located diametrically opposite thereto.

7. A machine according to claim 1, wherein said supporting means moves said member reciprocatingly.

8. A machine according to claim 1, wherein said mounting and actuating formation has an oblique portion thereof extending outwardly and upwardly through an opening in said tube.

9. In a form, fill and seal machine including a vertical forming and filling tube having an upper product receiving end portion and a lower product discharge end, a package-making film guiding collar means about said upper end portion of said tube, and film sealing and pull down means below said lower discharge end and functioning to draw package making film through said guide collar means into tubular relation about said tube and to draw the tubular film downwardly below said discharge end and then sealing the tubular film at bag width intervals;

spreader means at said discharge end for laterally stretching the tubularly formed bag making film in a vertical plane to eliminate wrinkle unevenness when the sealing means seals across the film;

said spreader means including an elongate one-piece rod like spreader member with a straight leg extending longitudinally within said tube, said leg further comprising as a fixed extension on a lower end thereof an integral angular spreader finger formation located at the discharge end of said tube within said tubular film and having an outwardly and downwardly slanting part;

an upper end portion of said member having an obliquely upwardly and outwardly extending mounting and actuating formation projecting through a hole in said tube in clearance relation to said guide shoulder means;

supporting means on said tube engaged by said upper end formation; and actuator means mounted on said tube and operatively controlling said upper end formation for effecting movements of said member and thereby controlling movements of said lower end finger formation between a wrinkle free spreading position of said slanting part relative to said tubular film and a retracted position for permitting relatively free downward movement of said tubular film when said sealing and pull down means pulls the tubular film downwardly.

10. A form fill and seal machine including a vertical forming and filling tube having a bag-making-film guide shoulder means on an upper end portion of the tube and film sealing and pull-down means operatively located below a lower end of the tube;

a spreader member comprising a one-piece rod means extending vertically in said tube, said rod means further comprising as a fixed extension thereof at said lower end of the tube a finger for wrinkle free spreading of the film below said lower end of said tube and above said sealing and pull-down means; and means for operating said rod means located on the outside of said upper end portion of said tube adjacent to but clear of said guide collar means and connected to an upper end part of said rod means.

11. A machine according to claim 10, wherein said operating means includes a device for causing the rod means and said finger to swing oscillatably into a protracted spreading position and a retracted clearance position.

12. A machine according to claim 10, wherein said upper end part of the rod means extends out of an opening in the tube.

13. A machine according to claim 10, including an overhanging bracket on said tube associated with said operating means, and said bracket having means for positionally controlling said rod means relative to said operating means.

14. A machine according to claim 10, wherein said finger comprises a portion which extends downwardly and outwardly on a slant for spreading engagement with the film.

15. A machine according to claim 10, including a fixed spreader finger on the lower end of said tube located diametrically opposite to said rod means finger.

16. A machine according to claim 10, wherein said rod means is reciprocatable into and out of spreading position.

17. A machine according to claim 10, wherein said rod means is oscillatably swingable by said operating means into and out of film spreading position of said finger.

18. A machine according to claim 10, wherein said upper end part has a portion thereof extending through an opening in said tube and a portion connected to said operating means.

19. A machine according to claim 16, wherein said operating means effects reciprocating of said rod means and thereby said finger, and said tube and said finger have cooperating cam surfaces for effecting oscillation of said finger when the finger is reciprocated with said rod means.

20. A machine according to claim 10, wherein said operating means is operable for effecting movements of said rod means in both reciprocating and oscillating movements and thereby effects the same movements of said finger.

* * * * *